US011541301B2

(12) United States Patent
Montandon et al.

(10) Patent No.: US 11,541,301 B2
(45) Date of Patent: Jan. 3, 2023

(54) METHOD AND APPARATUS FOR DETERMINING PLAY OUTCOME LIKELIHOODS IN CUE SPORTS

(71) Applicant: Singleshot Entertainment, Inc., Las Vegas, NV (US)

(72) Inventors: Eric Lewis Montandon, Las Vegas, NV (US); Jason Walter Lahser, Las Vegas, NV (US)

(73) Assignee: Salt Island Development, Inc., Gloucester, MA (US)

( * ) Notice: Subject to any disclaimer, the term of this patent is extended or adjusted under 35 U.S.C. 154(b) by 373 days.

(21) Appl. No.: 16/639,273

(22) PCT Filed: Aug. 13, 2018

(86) PCT No.: PCT/US2018/046421

§ 371 (c)(1),
(2) Date: Feb. 14, 2020

(87) PCT Pub. No.: WO2019/036320

PCT Pub. Date: Feb. 21, 2019

(65) Prior Publication Data

US 2020/0238160 A1 Jul. 30, 2020

Related U.S. Application Data

(60) Provisional application No. 62/545,278, filed on Aug. 14, 2017.

(51) Int. Cl.

| | |
|---|---|
| ***A63D 15/00*** | (2006.01) |
| ***A63D 15/20*** | (2006.01) |
| ***G07F 17/32*** | (2006.01) |

(52) U.S. Cl.

CPC ..... *A63D 15/006* (2013.01); *A63D 15/20* (2013.01); *G07F 17/3237* (2013.01); *G07F 17/3288* (2013.01)

(58) Field of Classification Search
None
See application file for complete search history.

(56) References Cited

U.S. PATENT DOCUMENTS

2006/0063599 A1* 3/2006 Greenspan ..... B25J 9/1697 473/1
2010/0178994 A1* 7/2010 Do ..... A63D 15/006 473/2

(Continued)

FOREIGN PATENT DOCUMENTS

| | | | |
|---|---|---|---|
| WO | 99002590 | A1 | 3/1990 |
| WO | 2011016963 | A1 | 2/2011 |
| WO | 2014000015 | A1 | 1/2014 |

OTHER PUBLICATIONS

International Search Report and Written Opinion of the International Searching Authority dated Nov. 14, 2018 and issued in International Application No. PCT/US2018/046421 filed on Aug. 13, 2018.

*Primary Examiner* — Jason T Yen
(74) *Attorney, Agent, or Firm* — Sorell, Lenna & Schmidt, LLP

(57) ABSTRACT

A method for determining the likelihoods of a cue sport player completing a run of shots for each of a plurality of non-break ball patterns is provided. The method initially involves operating a computer to retrieve a non-break ball pattern of the plurality of non-break ball patterns and to then facilitate the positioning of balls on a cue sport table in accordance with the non-break ball pattern. The positioning may be accomplished by use of a projector under control of the computer that projects ball positioning patterns on the sport table. The progress of the cue sport player through a run of the balls on the table is then monitored and the outcome of that progress, e.g. the number of balls in a run that are pocketed are recorded in association with the current (Continued)

non-break ball pattern. The procedure is repeated for further non-break ball patterns of the plurality of non-break ball patterns and the computer is then used to determine odds associated with runs for each of the non-break ball pattern based on the recorded outcomes.

15 Claims, 6 Drawing Sheets

(56) References Cited

U.S. PATENT DOCUMENTS

| | | | | |
|---|---|---|---|---|
| 2011/0021256 | A1* | 1/2011 | Lundback | G06K 9/00 463/2 |
| 2011/0053688 | A1 | 3/2011 | Crawford et al. | |
| 2016/0144268 | A1 | 5/2016 | Stimac | |
| 2016/0310828 | A1 | 10/2016 | Qiao et al. | |
| 2016/0317904 | A1* | 11/2016 | Qiao | G06F 3/0354 |

* cited by examiner

| Ball Pattern No. | Player No. | Runout | Miss Ball 1 | Miss Ball 2 | Miss Ball 3 | Miss Ball 4 | Miss Ball 5 | Miss Ball 6 | Miss Ball 7 |
|---|---|---|---|---|---|---|---|---|---|
| 1 | 1 | Yes | No | No | No | No | No | No | No |
| 2 | 1 | No | No | No | Yes | No | No | No | No |
| 3 | 1 | No | Yes | No | No | No | No | No | No |
| 4 | 2 | No | No | No | No | No | No | No | Yes |
| 5 | 2 | No | No | No | No | No | No | Yes | No |
| ... | | | | | | | | | |
| 24 | 2 | No | No | No | No | No | Yes | No | No |
| 25 | 2 | No | No | No | Yes | No | No | No | No |

METHOD AND APPARATUS FOR DETERMINING PLAY OUTCOME LIKELIHOODS IN CUE SPORTS

TECHNICAL FIELD

The present invention concerns methods and apparatus for determining the likelihood of a player successfully proceeding through a sequence of shots in respect of a ball pattern in a cue sport such as pool or snooker.

BACKGROUND ART

Any references to methods, apparatus or documents of the prior art are not to be taken as constituting any evidence or admission that they formed, or form part of the common general knowledge.

There are a number of situations where it would be advantageous to know the likelihood of a player successfully proceeding through a sequence of balls in a cue sport. For example, spectators may wish to guess the outcome of the play in order to be awarded a prize for making a correct guess. Games of this type are common in China and Japan for example where, apart from a relatively small number of venues, gambling is prohibited. Alternatively in other countries bookmakers would be able to take bets from punters in respect of a cue sport game if the bookmakers were able to estimate the likelihood of the players success.

Cue sports are well suited to prize games and to wagering since they are conducted in a controlled environment that can be readily attended by spectators or videoed and watched remotely.

However, it has been found that it is very difficult to consistently gauge the likelihood of a player successfully proceeding through a run of balls. There are a number of reasons for this. One reason is that in general the pattern of the balls on a snooker table at the start of each play is unique, apart from the initial break ball pattern in which the object balls are set up in either a triangular or diamond shaped pattern depending on the game in question. Due to the difficulty in consistently gauging the likelihood of a player successfully completing a run of balls, bookmakers and prize game administrators are reluctant to involve cue sports. Where cue sports markets have been available they are usually made at the start of a tournament and payouts have only been done once the entire game has concluded, which takes a long time.

It would be advantageous if it were possible to provide a method and apparatus that would determine the likelihood of play outcomes for cue sports such as pool and snooker or at least be of assistance in making such a determination.

SUMMARY OF THE INVENTION

The present invention concerns methods and apparatus for determining likelihoods of a cue sport player completing a run of shots for each of a plurality of non-break ball patterns.

Throughout the following the terms "non-break" and "breakless" game play means that the players do not make a conventional initial break by cueing the cue ball from the balk line into a triangle diamond or other specific shape of framed object balls. Similarly, a "non-break ball pattern" refers to a pattern of balls other than a break ball pattern which is typically set up at the start of a conventional game by means of a wooden or plastic triangular or diamond shaped frame.

According to a first aspect of the present invention there is provided a method for determining the likelihoods of a cue sport player completing a run of shots for each of a plurality of non-break ball patterns, the method comprising the steps of:

a) operating a computer to retrieve a non-break ball pattern of the plurality of non-break ball patterns;
b) operating the computer to facilitate the positioning of balls on a cue sport table in accordance with the non-break ball pattern;
c) monitoring the progress of the cue sport player through a run of the balls on the table;
d) recording the outcome of step in association with the non-break ball pattern;
e) repeating steps a) to d) for further non-break ball patterns of the plurality of non-break ball patterns;
f) operating the computer to determine odds associated with runs for each non-break ball pattern based on the recorded outcomes.

In a preferred embodiment of the invention the method includes operating the computer to randomly generate a number of non-break ball patterns and then culling the number of non-break ball patterns to arrive at the plurality of non-break ball patterns for positioning on the table.

For example, the step of culling the number of non-break ball patterns may include operating the computer to present each of the number of non-break ball patterns to a human expert and then culling or not culling each non-break ball pattern depending on a judgment from the human expert as to whether or not the non-break ball pattern is either too easy or too difficult for inclusion in the plurality of non-break ball patterns to be played.

Preferably each of the plurality of non-break ball patterns is played by each of more than one cue sport player in order that a statistically significant likelihood of the outcome is determined for each of said non-break ball patterns.

In a preferred embodiment of the invention the step of operating the computer to facilitate the positioning of the balls on the cue sport table includes operating a visual indicator device to indicate the location of the balls on the table in order for a human or a machine to place the balls. For example, a light projector may be positioned to produce areas of light on the table to indicate the locations of the balls of each of the non-break ball patterns.

Where the cue sport is pool then each of the object balls may bear a number and in that case the step of indicating the position of the balls may include projecting a number to indicate the placement of particular object balls of the non-break ball pattern that is to be positioned on the table.

In a preferred embodiment of the invention the step of indicating the position of the balls includes operating the visual indicator device to present a number of symbols for indicating whether or not balls are very close to each other or to a cushion.

Preferably the method includes recording the outcome of the player's progress through a run of balls of the pattern of balls on the table. For example, the pattern of balls may comprise "n" object balls that are sequentially numbered wherein the player is required to pot all of the object balls in numerical sequence. In that case whether or not the player was successful in potting 1, 2, . . . , n balls is recorded in step d) as an outcome.

The step of determining the probability values may include applying a binomial statistical analysis to the recorded outcomes.

In a preferred embodiment of the invention the "n" object balls comprise seven object balls.

The method may further comprise conducting a game including:

retrieving one of said plurality of non-break ball patterns for which odds have been associated therewith;

operating the computer to facilitate the positioning of balls on a cue sport table, which table may or may not be the table previously referred to in step b), in accordance with the non-break ball pattern;

making the associated odds for the non-break ball pattern available remotely, for example to bookmakers or game administrators.

According to another aspect of the present invention there is provided an apparatus for determining cue sport player outcome likelihood (or "odds") for each of a plurality of non-break ball patterns, the apparatus comprising:

a computer system in data communications with a data source storing the plurality of non-break ball patterns;

a cue sport play surface;

a ball position facilitator apparatus responsive to the computer system and arranged to facilitate placement of balls at positions of the said play surface for each of the plurality of non-break ball patterns;

wherein the computer system is programmed to associate player outcomes with each of the plurality of non-break ball patterns.

In a preferred embodiment of the invention the computer system is programmed to present a user interface for entry of the outcome for the cue sport player in respect of the non-break ball pattern.

Preferably the apparatus is arranged for determining the outcome of non-break ball patterns comprising seven object balls.

According to another aspect of the present invention there is provided a method for determining the likelihoods of a cue sport player completing a run of shots for each of a plurality of non-break ball patterns, the method including:

a) operating a computer to retrieve a non-break ball pattern of the plurality of non-break ball patterns;

b) operating the computer to facilitate the positioning of balls on a cue sport table in accordance with the non-break ball pattern;

c) monitoring the progress of the cue sport player through a run of the balls on the table;

d) recording the outcome of step c) in association with the non-break ball pattern;

e) repeating steps a) to d) for further non-break ball patterns of the plurality of non-break ball patterns.

Preferably the method includes operating the computer to determine probability values (or "odds") associated with runs for each non-break ball pattern based on the recorded outcomes.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
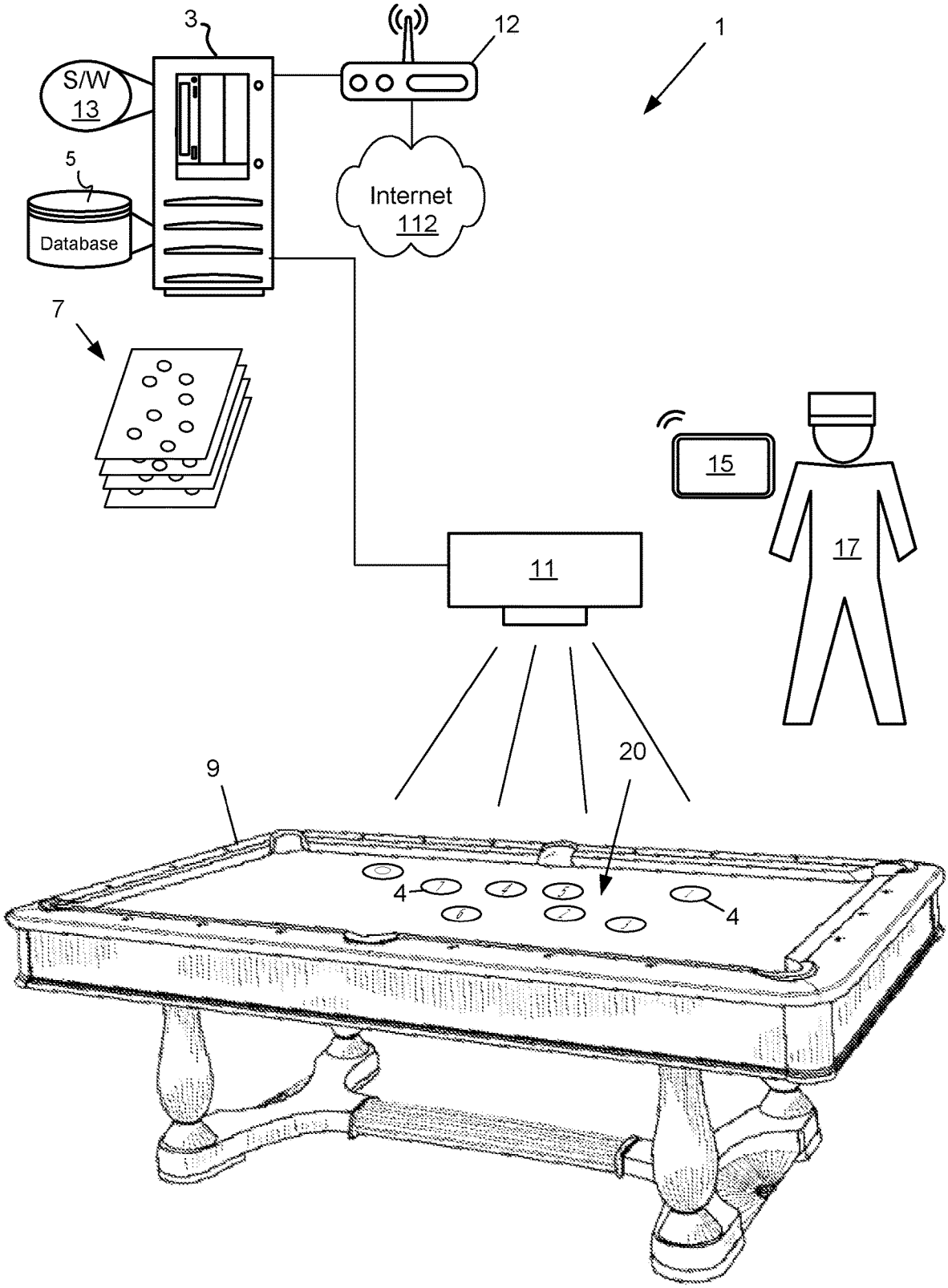
FIG. 1 is a block diagram of an apparatus according to a preferred embodiment of the present invention for determining cue sport player outcome likelihoods or "odds" for each of a plurality of non-break ball patterns.

Referring now to FIG. 1 there is illustrated a first block diagram of an apparatus 1 for implementing a method according to a preferred embodiment of the present invention.

As will be explained, apparatus 1 is specially arranged to determine cue sport player outcome likelihoods (or "odds") for each of a plurality of non-break ball patterns. Apparatus 1 includes a computer system 3 which is in data communications with a data source in the form of a database 5. The database 5 is comprised of tables that store a plurality of non-break ball patterns 7.

Figure 2:
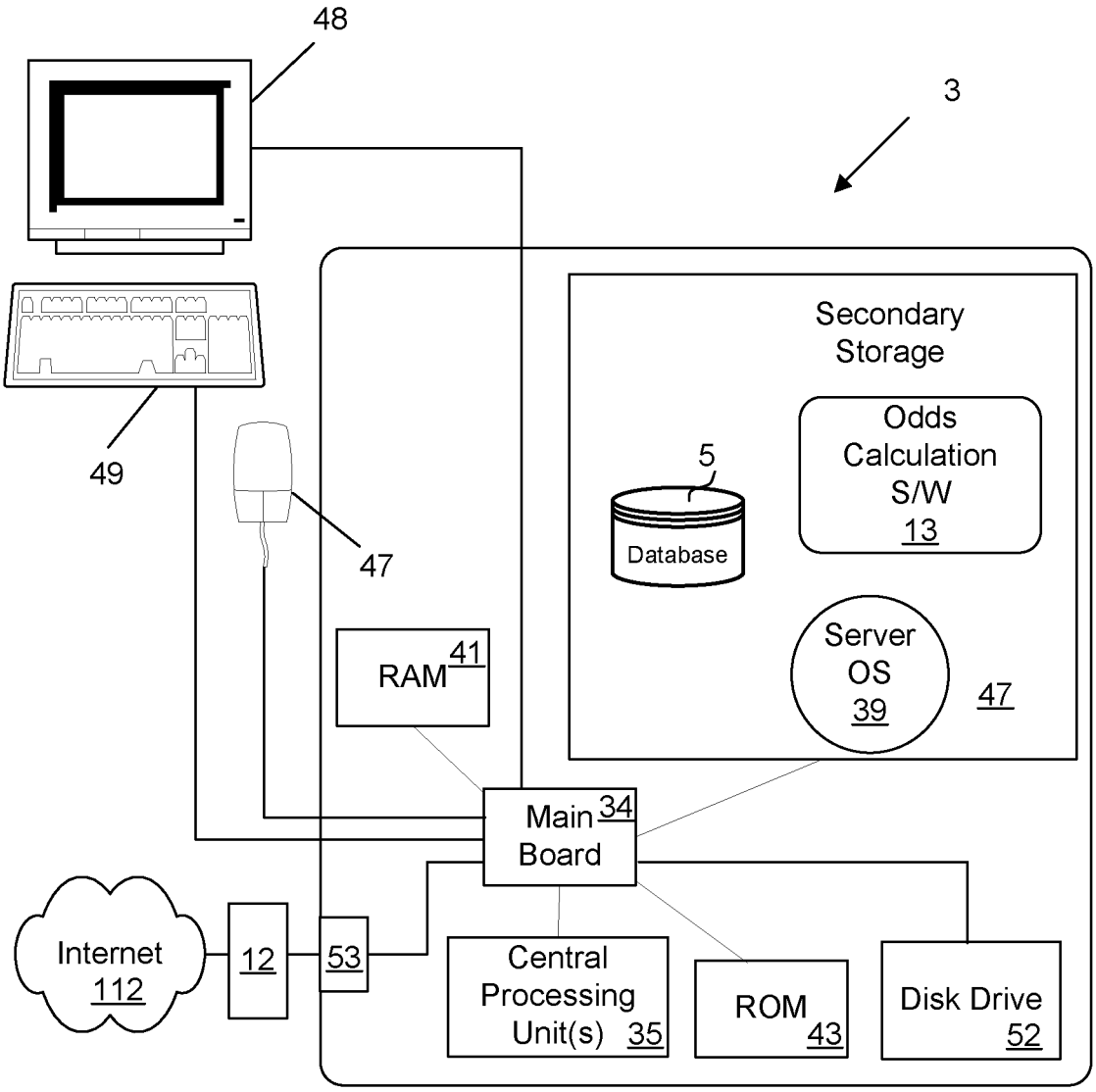
FIG. 2 is a block diagram of a computer system that is used in implementing the apparatus of FIG. 1.

FIG. 2 comprises a block diagram of an example of a computer system in the form of a computer 3 which is programmed with a cue sport odds determination software product 13 to enable the server to undertake its various tasks as described herein. The computer system 3 includes secondary storage 47, which is typically implemented by a magnetic or solid state data drive and which stores a server operating system, for example Microsoft Windows Server and Ubuntu Linux Server are two examples of such an operating system.

Computer system 3 includes a main board 34 which includes circuitry for powering and interfacing to at least one onboard central processing unit or "processor" or "microprocessor" 35. The at least one onboard processor 35 may comprise two or more discrete processors or processors with multiple processing cores.

The main board 34 acts as an interface between CPUs 35 and secondary memory 47. The main board 34 also communicates with Random Access Memory (RAM) 41 and Read Only Memory (ROM) 43. The ROM 43 typically stores instructions for a Basic Input Output System (BIOS) which the CPUs 35 access upon start up and which prepares the CPUs 35 for loading of the operating system 39 from secondary memory 47.

The main board 34 will typically include a communications adapter, for example a LAN adaptor 53 that places the computer system in data communication with a computer network such as the Internet 112 via a router 12 or other suitable network interface device.

The computer system 3 may include a human-to-machine interface (HMI) in the form of keyboard 49, mouse 47 and display 48 which enables administrator to directly enter commands, read output, and generally interact with the server as the CPUs 35 execute various operating system and application software instructions. Alternatively, and more commonly, the administrator logs into the computer system 3 remotely over a local network or the Internet 112 or another data network and performs administrative tasks remotely using a local terminal, for example running on a tablet 15, as the HMI.

The secondary storage 47 also includes the cue-sport odds determination software 13 according to a preferred embodiment of the present invention which implements database 5 that is also stored in the secondary storage 47. During operation of the computer system 3 the processor assembly 35 loads the operating system 39 and then loads the odds determination software 13.

It will be realised that the exemplary computer system 3 that is illustrated in FIG. 2 comprises a discrete hardware machine that is suitably programmed. In other embodiments of the invention the server may be implemented by a virtual machine, e.g. a "cloud server" that uses shared hardware resources of a "server farm" as required.

Returning again to FIG. 1, the apparatus 1 further includes a cue sport play surface in the form of a pool or billiards table 9.

Apparatus 1 is also provided with a ball positioning facilitator in the form of a projector 11 that is coupled to the computer system 3 and thus responsive thereto. In use the projector 11 projects an image 20 including location indicators 4 on the table 9 at which balls making up the pattern are to be placed. It will be realised that the ball position facilitator in the form of projector 11 is only one way of placing the balls on the table. For example as an alternative a robotic arm which would be "indicator-less" or an array of lasers which indicate ball positions instead of projector could be used.

A purpose of apparatus 1 is to be able to provide a repeatable pattern/spread of balls with a negligible margin of error on ball location.

The projector 11 is arranged above table 9 to project ball position indications 4 onto the play surface 9 for each of the plurality of non-break ball patterns 7.

The computer system 3 is programmed with the computer software product 13 which includes instructions for the computer system to retrieve non-break ball patterns 7 from the database 5 and subsequently to associate player outcomes with each of the plurality of non-break ball patterns.

The non-break ball patterns 7 that are used are derived by the computer system randomly generating a large number of non-break ball patterns and then culling those to arrive at the plurality of non-break ball patterns 7 for positioning on the table.

For example, the step of culling the number of non-break ball patterns may include operating the computer system 3 to present each of the number of non-break ball patterns 7 to an expert, e.g. administrator 17 via tablet 15 and then culling or not culling each non-break ball pattern depending on a judgment from the expert as to whether or not the non-break ball pattern is either too easy or too difficult for inclusion in the plurality of non-break ball patterns to be played.

Each non-break ball pattern 7 includes a location on the table for a cue ball and locations for a number of object balls. In the presently discussed preferred embodiment of the invention the object balls are Kelly pool balls which each bear a sequential integer 1, . . . , n where "n" is preferably the number "7" but could be another number. While Kelly pool balls are preferred, embodiments of the present invention may also encompass snooker balls, billiards and other of the various ball sets that are used in cue sport games.

The user interface 15 may be used by the administrator 17 to enter the outcome of each player's shots in regard to each non-break ball pattern and more particularly how far through the sequence of balls (i.e. a "run") the player successfully advanced.

In use, the apparatus 1 implements a method for determining the likelihoods (i.e. odds) for each of the plurality of non-break ball patterns 7. Firstly, in an initialization phase the computer system 3 confirms its connection with the projector 11. A test image, for example including a balk line and frame alignment dot may then be projected onto the play surface, for example table 9. The administrator 17 is then prompted via the interface in the form of tablet 15 to indicate whether or not the projector 11 is correctly calibrated relative to the play surface. If is not correctly calibrated then the computer system 3 runs a calibration routine which will involve requesting feedback from the administrator 17 via the tablet 15 until correct calibration of projector 11 is achieved so that the projector 11 correctly indicates the positions of the balls for each non-break ball pattern on the table.

Once the projector has been calibrated the computer system 3 retrieves a non-break ball pattern 7*i* from the plurality of non-break ball patterns 7 that are stored in the database 5. As previously mentioned, the non-break ball patterns that are used have each been checked by a human expert, or possibly a suitably trained artificial intelligence agent to ensure that they are neither infeasibly difficult nor much too easy for playing.

The computer system 3 then facilitates the positioning of balls on the cue sport table 9 in accordance with the non-break ball pattern 7*i* by projecting indicators onto the table 9 as shown in FIG. 1. The balls are then positioned by administrator 2. Preferably symbols 22*a*, 22*b*, 22*c* and 22*d* illustrated in FIGS. 3 and 4 are also projected to respectively indicate whether a ball is close to a cushion but not touching, touching a cushion, touching another ball or close but not touching another ball.

Figure 3:
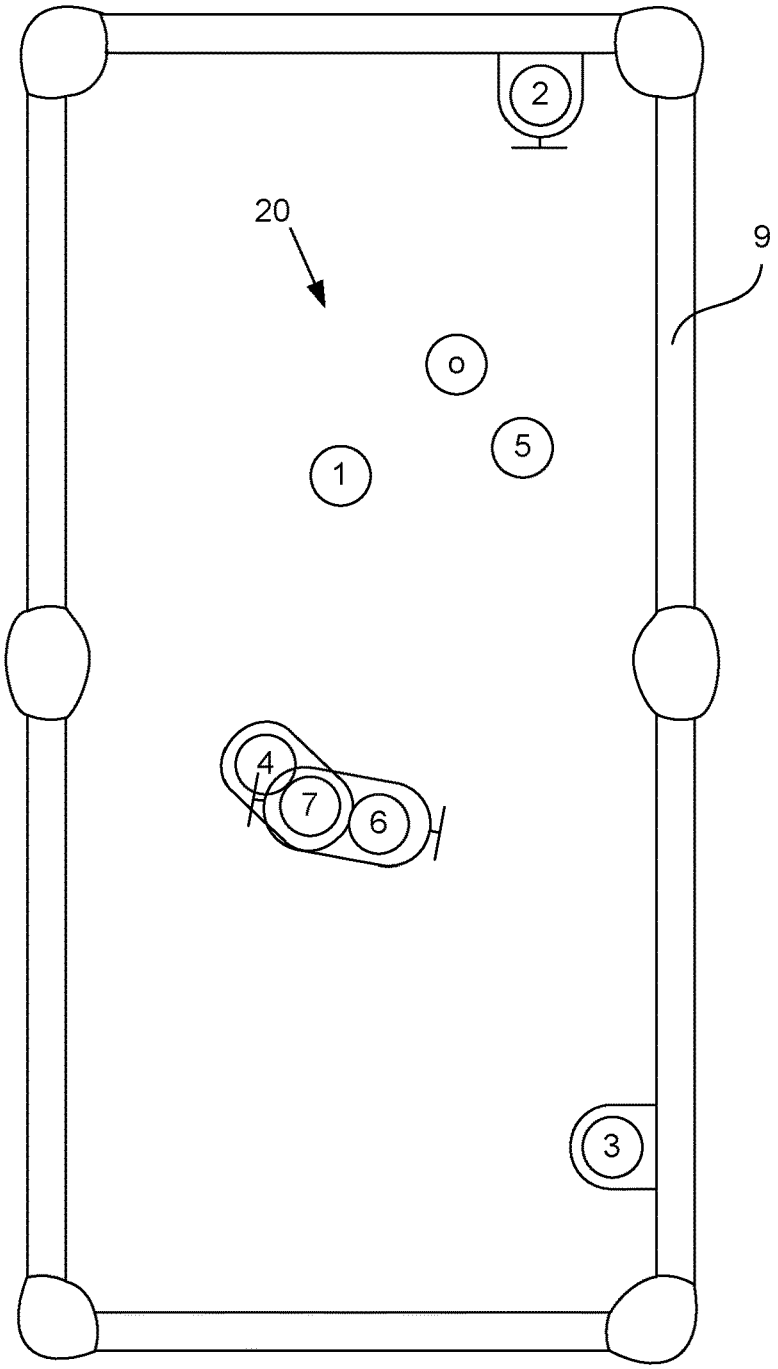
FIG. 3 is a plan view of a cue sports table with a ball placement image projected thereon.
Figure 4:
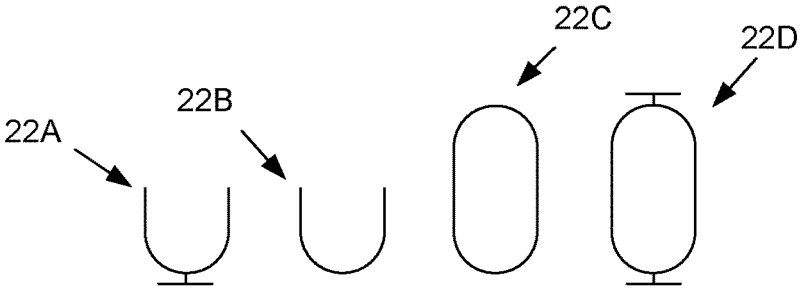
FIG. 4 indicates ball proximity symbols that form part of the image shown in FIG. 3.

As shown in FIG. 1 and FIG. 3, the image 20 that is projected shows the positions for placement of the numbered object pool balls 23-1, 23-2, . . . , 23*n* and also the position for placement of the cue ball 25.

Figure 5:
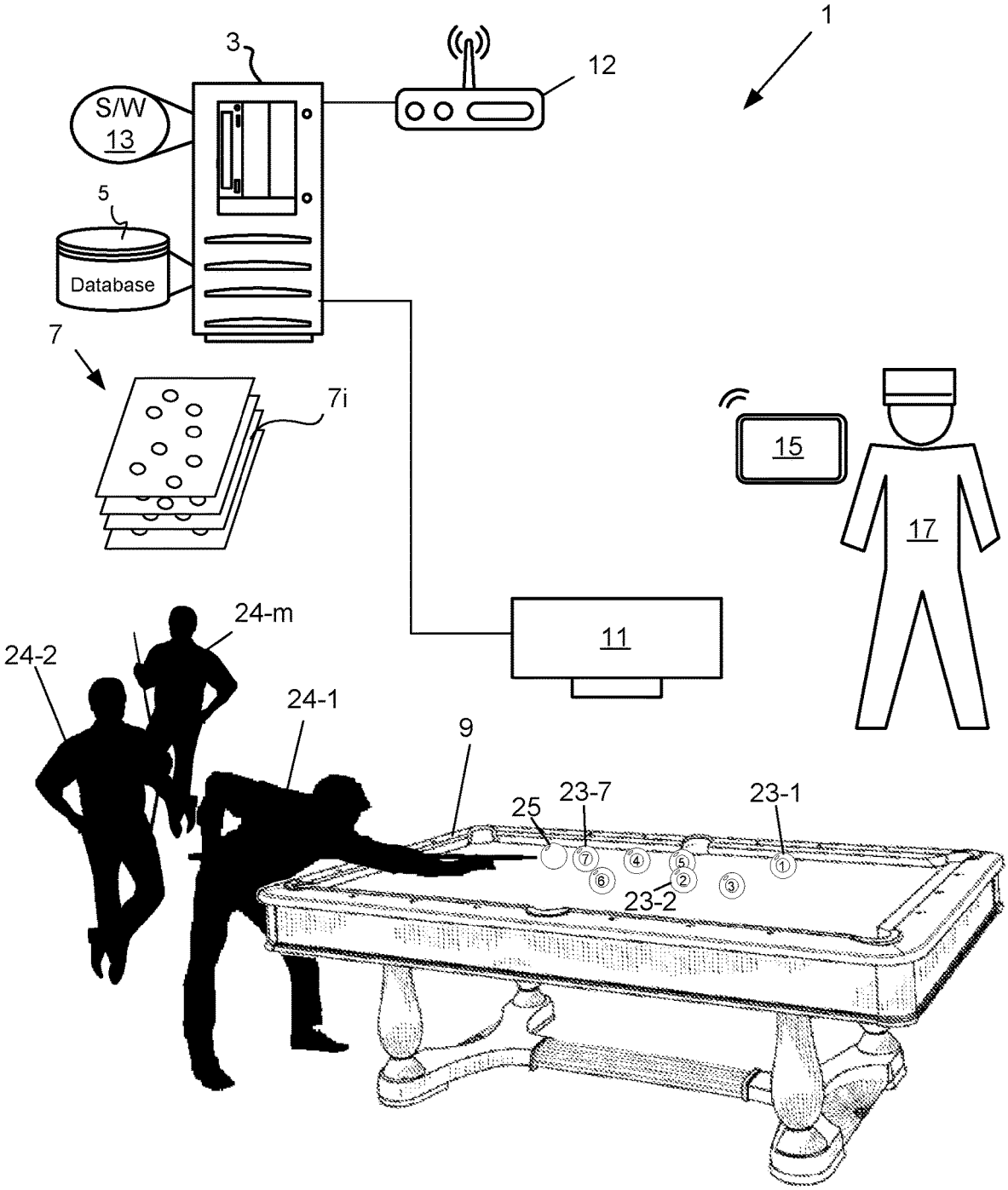
FIG. 5 shows the apparatus of FIG. 1 in a further stage of use wherein a number of players play non-break ball patterns and the players' outcomes are recorded by the computer system.

The administrator 17 walks around the table and positions the cue ball 25 and the object balls 23-1, . . . , 23*n* on the table 9 in accordance with the projected image 20. Once the balls have been placed on the table 9, as shown in FIG. 5, the administrator 17 indicates such to the computer system 3 by means of the tablet 15. Administrator 17 receives a message from computer system 3 to commence play and advises player 24-1 to begin. The player 24-1 then strives to progress through a run of shots. That is player 25 strikes the cue ball 25 in order to pot object ball 23-1 and set up for subsequently potting object ball 23-2 and so on until all of the balls up to 23-*n* have been potted.

Figure 6:
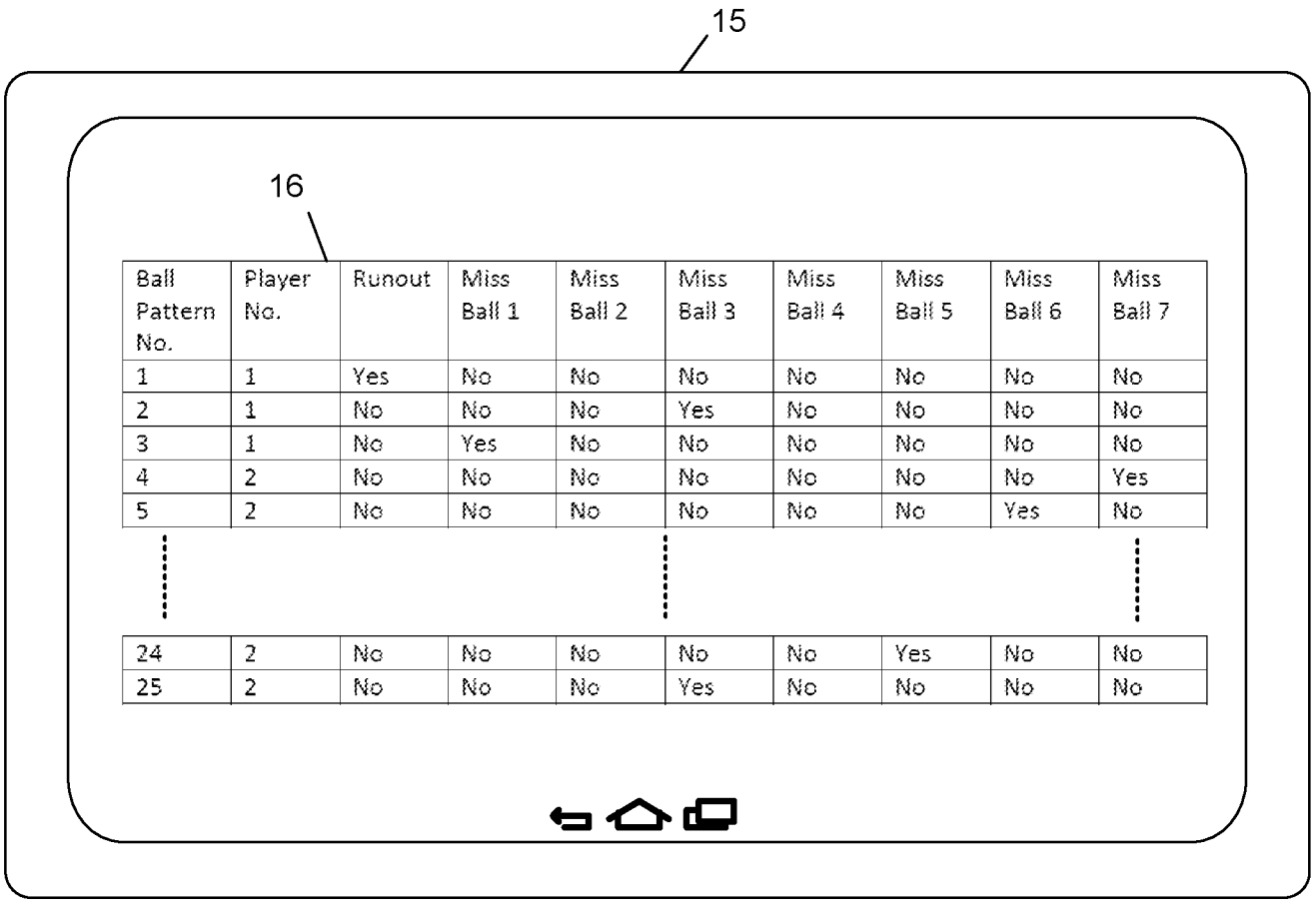
FIG. 6 is a screen shot of a table used to record player outcomes for each of a number of non-break ball patterns.

A perfect run will entail the player 25 potting all of the object balls 23-1, . . . , 23-*n* in sequential order and without fouling. However, often the player will be unable to accomplish a perfect run and so the run will finish before all of the object balls have pocketed. For example the player 24 may only pot one or two balls but in any case not all. The extent of the run, i.e. the outcome that the player 24 makes each time the player plays a particular non-break ball pattern is recorded. The administrator 17 monitors the player performance and enters the player's outcomes in a form 16 that is served by computer system 3 and presented on tablet 15, as shown in FIG. 6. The form 16 records the number of balls that the run progressed for the particular non-break ball pattern. For example, it will be observed that player No. 1 achieved a runout, i.e, a perfect run in which all the object balls were potted, for non-break ball pattern No. 1. The data that is entered is recorded by the computer system 3 and associated with the particular pattern in database 5. Over time further players 24-2, . . . , **24-*m* are presented with each of the non-break ball patterns 7 and their play outcomes for each non-break ball pattern are also recorded. Subsequently the computer system 3** processes all of the outcomes for all of the players in respect of each pattern. This processing is done using conventional statistical analysis with a binomial distribution on sufficient outcomes to preferably achieve a statistical likelihood within $P<0.05$, of the odds of a run on a particular non-break ball pattern. That is, for a given non-break ball pattern the odds of a player making a perfect run (in which all n balls are potted) is calculated and similarly the odds of a player making an imperfect run in which each of n−1 down to zero of the balls being potted are also calculated.

Subsequently, once the computer system 3 has associated odds for each possible run for all of the non-break ball patterns then a game may be conducted.

Figure 7:
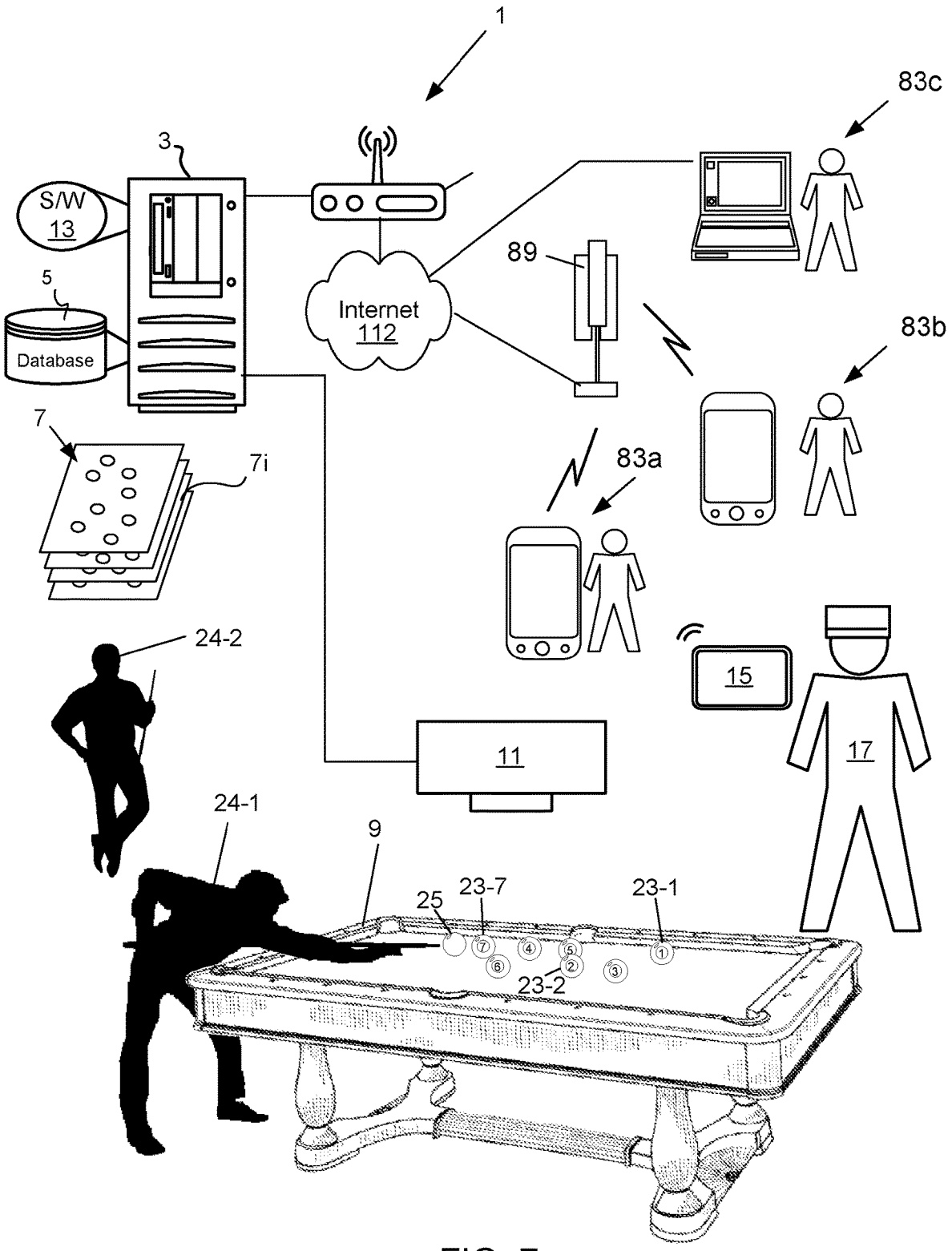
FIG. 7 illustrates the use of the apparatus of FIG. 1 during a match wherein odds for a player in relation to a non-break ball pattern in play are distributed to a number of remote book makers and game administrators.

With reference to FIG. 7, conducting a game includes operating the computer system 3 to retrieve one of the plurality of non-break ball patterns 7 for which odds have been associated therewith. The computer system then makes the associated odds for the current non-break ball pattern available remotely, for example to bookmakers or game administrators **83*a*, 83*b*, 83*c* via a data network such as the Internet 112 and broadband cellular infrastructure 89**. Once the bookmakers and game administrators have received the odds for the particular non-break ball pattern then they can factor in their own margins such as a "house advantage".

About fifteen minutes after transmitting the odds computer system 3 then operates the projector 11, or some other ball placement facilitation device, to facilitate positioning of the balls 23-1, . . . , **23-*n* on the table 9**. Obviously the balls need not be positioned on the table that was previously used provided that the calibration steps have been successfully performed. A video camera will also be set up to stream video of the game which can be watched via the Internet, on live to air or by cable TV or through any other of the available broadcast avenues.

As previously discussed, the present method and apparatus may be used with a variety of cue sports however in a preferred embodiment the method and apparatus are particularly tailored for breakless (i.e. non-break), 7-ball pool. As explained, by "breakless" or "non-break" it is meant that the players do not make a conventional initial break from the balk line into a triangle diamond or other specifically shaped of object balls.

By avoiding the break that commences a traditional game of pool or snooker the associated significant degree of randomness is not encountered. The player's performance in relation to non-break ball patterns is not prone to the high level of randomness of the break. Therefore, the likelihood of a player's success may be gauged more accurately for non-break ball patterns and thus the likelihood of a player successfully completing a run of balls can be estimated. Therefore, bookmakers and prize game administrators who have hitherto been reluctant to involve cue sports may now be extend their activities to cover cue sports such as a 7-ball breakless pool game comprised of non-break ball patterns.

In compliance with the statute, the invention has been described in language more or less specific to structural or methodical features. The term "comprises" and its variations, such as "comprising" and "comprised of" is used throughout in an inclusive sense and not to the exclusion of any additional features. It is to be understood that the invention is not limited to specific features shown or described since the means herein described herein comprises preferred forms of putting the invention into effect.

The invention is, therefore, claimed in any of its forms or modifications within the proper scope of the appended claims appropriately interpreted by those skilled in the art.

Throughout the specification and claims (if present), unless the context requires otherwise, the term "substantially" or "about" will be understood to not be limited to the value for the range qualified by the terms.

Any embodiment of the invention is meant to be illustrative only and is not meant to be limiting to the invention. Therefore, it should be appreciated that various other changes and modifications can be made to any embodiment described without departing from the spirit and scope of the invention.

The invention claimed is:

1. A method for determining the likelihoods of a cue sport player completing a run of shots for each of a plurality of non-break ball patterns, the method comprising the steps of:

a) operating a computer to retrieve a non-break ball pattern of the plurality of non-break ball patterns;

b) operating the computer to facilitate the positioning of balls on a cue sport table in accordance with the non-break ball pattern;

c) monitoring the progress of the cue sport player through a run of the balls on the table;

d) recording the outcome of step c) in association with the non-break ball pattern;

e) repeating steps a) to d) for further non-break ball patterns of the plurality of non-break ball patterns;

f) operating the computer to determine odds associated with runs for each non-break ball pattern based on the recorded outcomes, wherein the step of operating the computer to facilitate the positioning of the balls on the cue sport table includes operating a visual indicator device to indicate the location of the balls on the table in order for a human or a machine to place the balls.

2. The method according to claim 1 including operating the computer to randomly generate a number of non-break ball patterns and then culling the number of non-break ball patterns to arrive at the plurality of non-break ball patterns for positioning on the table.

3. The method according to claim 2, wherein the step of culling the number of non-break ball patterns includes operating the computer to present each of the number of non-break ball patterns to a human expert and then culling or not culling each non-break ball pattern depending on a judgment from the human expert as to whether or not the non-break ball pattern is either too easy or too difficult for inclusion in the plurality of non-break ball patterns to be played.

4. The method according to claim 1, wherein each of the plurality of non-break ball patterns is played by each of more than one cue sport player.

5. The method according to claim 1, wherein the visual indicator device comprises a light projector that is positioned to produce areas of light on the table to indicate the locations of the balls of each of the non-break ball patterns.

6. The method according to claim 5, wherein each of the object balls bears a number and wherein the step of indicating the position of the balls includes projecting a number to indicate the placement of particular object balls of the non-break ball pattern that is to be positioned on the table.

7. The method according to claim 1, wherein the step of indicating the position of the balls includes operating the visual indicator device to present a number of symbols for indicating whether or not balls are very close to each other or to a cushion.

8. The method according to claim 1, wherein the method includes recording the outcome of the player's progress through a run of balls of the pattern of balls on the table.

9. The method according to claim 8, wherein the pattern of balls comprises "n" object balls that are sequentially numbered wherein the player is required to pot all of the object balls in numerical sequence and wherein whether or not the player succeeds in potting 1, 2, . . . , n balls is recorded in step d) as an outcome.

10. The method according to claim 9, wherein the "n" object balls comprise seven object balls.

11. The method according to claim 1, wherein the step of determining the probability values includes applying a binomial statistical analysis to the recorded outcomes.

12. The method according to claim 1 including:

retrieving one of said plurality of non-break ball patterns for which odds have been associated therewith;

operating the computer to facilitate the positioning of balls on a cue sport table, which table may or may not be the table previously referred to in step b), in accordance with the non-break ball pattern;

making the associated odds for the non-break ball pattern available remotely to game administrators.

13. An apparatus for determining cue sport player odds for each of a plurality of non-break ball patterns, the apparatus comprising:

a computer system in data communications with a data source storing the plurality of non-break ball patterns;

a cue sport play surface;

a ball position facilitator apparatus responsive to the computer system and arranged to facilitate placement of balls at positions of the said play surface for each of the plurality of non-break ball patterns;

wherein the computer system is programmed to associate player outcomes with each of the plurality of non-break ball patterns, wherein the ball position facilitator apparatus comprises a visual indicator device to indicate the location of the balls on the table in order for a human or a machine to place the balls.

14. The apparatus according to claim 13, wherein the computer system is programmed to present a user interface for entry of the outcome for the cue sport player in respect of the non-break ball pattern.

15. The apparatus according to claim 14, wherein the apparatus is arranged to determine the outcome of non-break ball patterns comprising seven object balls.

* * * * *